US011215326B2

(12) United States Patent
Yan et al.

(10) Patent No.: US 11,215,326 B2
(45) Date of Patent: Jan. 4, 2022

(54) FILAMENT LAMP LIGHTING MODULE AND MANUFACTURING METHOD THEREOF

(71) Applicant: Hangzhou Hangke Optoelectronics Group Co., Ltd., Hangzhou (CN)

(72) Inventors: Qianjun Yan, Hangzhou (CN); Qili Xu, Hangzhou (CN); Zhaozhang Zheng, Hangzhou (CN)

(73) Assignee: Hangzhou Hangke Optoelectronics Group Co., Ltd., Hangzhou (CN)

( * ) Notice: Subject to any disclaimer, the term of this patent is extended or adjusted under 35 U.S.C. 154(b) by 0 days.

(21) Appl. No.: 17/021,729

(22) Filed: Sep. 15, 2020

(65) Prior Publication Data

US 2021/0364133 A1 Nov. 25, 2021

(30) Foreign Application Priority Data

| | | |
|---|---|---|
| May 22, 2020 | (CN) | 202010441512.7 |
| May 22, 2020 | (CN) | 202020876173.0 |
| Jul. 2, 2020 | (CN) | 202010626383.9 |
| Jul. 2, 2020 | (CN) | 202021266072.8 |

(51) Int. Cl.

| | |
|---|---|
| ***F21K 9/235*** | (2016.01) |
| ***F21V 23/04*** | (2006.01) |
| ***F21K 9/90*** | (2016.01) |
| ***F21K 9/232*** | (2016.01) |

(52) U.S. Cl.

CPC ..... *F21K 9/235* (2016.08); *F21K 9/232* (2016.08); *F21K 9/90* (2013.01); *F21V 23/0435* (2013.01)

(58) Field of Classification Search

None

See application file for complete search history.

(56) References Cited

U.S. PATENT DOCUMENTS

| | | | | |
|---|---|---|---|---|
| 10,731,799 | B2 * | 8/2020 | Dendorfer | F21K 9/238 |
| 2013/0147350 | A1 * | 6/2013 | Yang | H05B 45/50 315/52 |
| 2017/0102114 | A1 * | 4/2017 | Xiong | F21K 9/278 |
| 2017/0122499 | A1 * | 5/2017 | Lin | F21V 23/003 |
| 2018/0045380 | A1 * | 2/2018 | Li | F21V 3/02 |
| 2018/0080611 | A1 * | 3/2018 | Haberkorn | F21K 9/238 |
| 2019/0128482 | A1 * | 5/2019 | Jiang | H05B 45/00 |
| 2019/0195435 | A1 * | 6/2019 | Ye | F21K 9/232 |
| 2020/0035878 | A1 * | 1/2020 | Jiang | F21K 9/232 |
| 2020/0154545 | A1 * | 5/2020 | An | H05B 45/3577 |
| 2020/0378563 | A1 * | 12/2020 | Gao | F21V 29/80 |

* cited by examiner

*Primary Examiner* — Britt D Hanley

(74) *Attorney, Agent, or Firm* — Schwegman Lundberg & Woessner, P.A.

(57) ABSTRACT

A filament lamp lighting module and a manufacturing method thereof, the filament lamp lighting module comprise: at least two upper bridges with at least two bridge arms; and at least three lower bridges with at least one bridge arm; the lower bridge includes two rectifying bridges comprising rectifying bridge arms; the rectifying bridges are connected with the external power supply, the rectifying bridge arms are respectively connected with one ends of two rectifying diodes, and the other ends of the two rectifying diodes are respectively connected with different upper bridges to form a rectifying circuit; the lower bridge includes a bridge arm connected with one end of the filament, and the other end of the filament is connected with an upper bridge arm for rectifying and supplying power to the filament.

12 Claims, 7 Drawing Sheets

FILAMENT LAMP LIGHTING MODULE AND MANUFACTURING METHOD THEREOF

CROSS-REFERENCE TO RELATED APPLICATIONS

This Non-provisional application claims priority under 35 U.S.C. § 119(a) on Chinese Patent Application No. 202010441512.7 filed on May 22, 2020, Chinese Patent Application No. 202020876173.0 filed on May 22, 2020, Chinese Patent Application No. 202010626383.9 filed on Jul. 2, 2020, and Chinese Patent Application No. 202021266072.8 filed on Jul. 2, 2020, the entire contents of which are hereby incorporated by reference.

TECHNICAL FIELD

The invention relates to a field of illumination, and in particular to a filament lamp lighting module and a manufacturing method thereof.

BACKGROUND ART

A LED filament lamp is widely used as an energy-saving and environment-friendly lighting device. In the prior art, an LED filament lamp comprises an LED filament, an AC-DC power supply and a lamp cap, in which the lamp cap is connected to an alternating main, and the AC-DC power supply is connected with the alternating main and converts it into a direct current for the LED filament to light; however, in the prior art, a traditional AC-DC power supply presents a high cost, with its PCB being sintered and fixed in the lamp cap which is inconvenient for installation and maintenance, as well as production, of the filament lamp.

SUMMARY

One of main objects of the present invention is to provide a filament lamp lighting module and a manufacturing method thereof, in which the filament lamp lighting module can be driven to light without a driving power supply, and an alternating current can be converted into a direct one by providing at least two filaments and four rectifier diodes, thereby reducing manufacturing cost.

Another main object of the present invention is to provide a filament lamp lighting module and a manufacturing method thereof, in which parallel filaments can be extended in the filament lamp lighting module by directly increasing a number of bridge arms of an upper bridge and lower bridge, the upper bridge arms and the lower bridge arms are electrically connected with filaments.

Another main object of the present invention is to provide a filament lamp lighting module and a manufacturing method thereof, in which series filaments can be extended in the filament lamp lighting module by directly increasing a number of upper bridge sets and lower bridge sets and electrically connecting filaments with different bridges, and various types of series-parallel structures can be achieved by the extending, which can be made only by designing bridge sets and bridge arms, of filaments, thus reducing the design and manufacturing cost of filament lamps with various lighting forms.

Another object of the present invention is to provide a filament lamp lighting module and a manufacturing method thereof, in which the filament lamp lighting module is connected by a bridge with a plurality of wires so that the filament presents better stability.

Another object of the present invention is to provide a filament lamp lighting module and a manufacturing method thereof, in which the filament lamp lighting module is provided with an upper bridge set and a lower bridge set, and the filament lamp and a rectifier diode are respectively electrically connected with the upper bridge set and the lower bridge set through hard wires, and the upper bridge set and the lower bridge set are connected with a stem of the filament lamp lighting module, so that the assembly efficiency of the filament lamp lighting module can be directly improved by a high-frequency direct current welding, which facilitates an automatic processing.

Another object of the present invention is to provide a filament lamp lighting module and a manufacturing method thereof, in which a PCB control plate of the filament lamp without a driving chip is installed inside the lamp cap, which reduces the processing of the lamp cap and prolongs service life thereof.

In order to achieve at least one of the above objects, the present invention further provides a filament lamp lighting module which includes a lamp cap, a filament and a stem, in which the lamp cap is connected with the stem, the lamp cap is connected to an external power supply, and the filament is used to be electrically connected with the external power supply, comprising:

at least two upper bridges, the upper bridges are provided with at least two upper bridge arms; and at least three lower bridges, each lower bridge is provided with a bridge arm;

wherein the at least three lower bridges comprises two rectifying bridges, the bridge arms comprise a lower bridge arm and at least two rectifying bridge arms, the two rectifying bridges comprise the at least two rectifying bridge arms; the rectifying bridges are connected with the external power supply; two of the rectifying bridge arms are respectively connected with one ends of two rectifying diodes, and the other ends of the two rectifying diodes are respectively connected with different upper bridges, forming a rectifying circuit; the lower bridges comprise the lower bridge arm connected with one end of the filament, and the other end of the filament is connected with an upper bridge arm, for rectifying and supplying power to the filament.

According to one of preferred embodiments of the present invention, two rectifying bridge arms extend from the rectifying bridge and the two rectifying bridge arms are respectively connected with one ends of two rectifier diodes, and the other ends of the two rectifier diodes are respectively connected with bridge arms of different upper bridges.

According to another preferred embodiment of the present invention, each upper bridge is provided with a bridge body which is located at the top of the stem, and the upper bridge arms are located at both ends of the bridge body and in a bifurcated structure.

According to another preferred embodiment of the present invention, a binding end is provided at the top of the stem and connected with a middle of the bridge body, and the binding end is connected with a plurality of bridge bodies, and the plurality of bridge bodies are relatively fixed at the top of the stem.

According to another preferred embodiment of the present invention, the lower bridges include at least one node, each node is connected with a wire extending from bottom to top, and one of the rectifier diodes is connected to the wire at the node.

According to another preferred embodiment of the present invention, a constant current chip is provided inside the filament and electrically connected with a wire, outputting a constant current to the filament.

According to another preferred embodiment of the present invention, the filament lamp lighting module includes a filter capacitor which is fixed above or below the upper bridges, two terminals of the filter capacitor are respectively electrically connected and fixed to two different upper bridges, and the filter capacitor is connected with a discharge resistor.

According to another preferred embodiment of the present invention, a surface of the filter capacitor is coated with a reflective material. According to another preferred embodiment of the present invention, a wire is connected below each node, the wire is connected with the lamp cap and connected with the external power supply; and a safety component is disposed at the wire below the node.

According to another preferred embodiment of the present invention, the lamp cap is connected to the stem with a column and a base, and the rectifying bridges have at least one node, and the wire at a bottom of the node is connected with a wire end at the base and the rectifying bridges are connected with the external power line through the wire.

According to another preferred embodiment of the present invention, the lamp cap is internally provided with an accommodating cavity in which a dimmer module is arranged, and the dimmer module is connected with at least one of a WiFi module, a Zigbee module and a Bluetooth module for adjusting an emission luminance and a lighting mode of the filament lamp lighting module.

According to another preferred embodiment of the present invention, the node of the lower bridge extends to form at least one bridge arm for connecting with the rectifier diodes or filaments.

In order to achieve at least one of the above objects, the present invention further provides a filament lamp comprising:

a bulb housing; and a filament lamp lighting module described above;

a filament of the filament lamp lighting module comprises LED lighting strips.

The invention further provides a manufacturing method of a filament lamp lighting module, which includes following steps:

providing a stem, in which a binding end of the stem and a base of the stem are respectively fixedly connected with a plurality of upper bridges and a plurality of lower bridges, the lower bridges comprise at least two rectifying bridges;

simultaneously and respectively spot welding a lower end and an upper end of each rectifier diode to bridge arms of the rectifying bridges and the upper bridges at a preset angle; and simultaneously spot welding a lower end and an upper end of a filament to bridge arms of the upper bridges and lower bridges at another preset angle.

Figure 1:
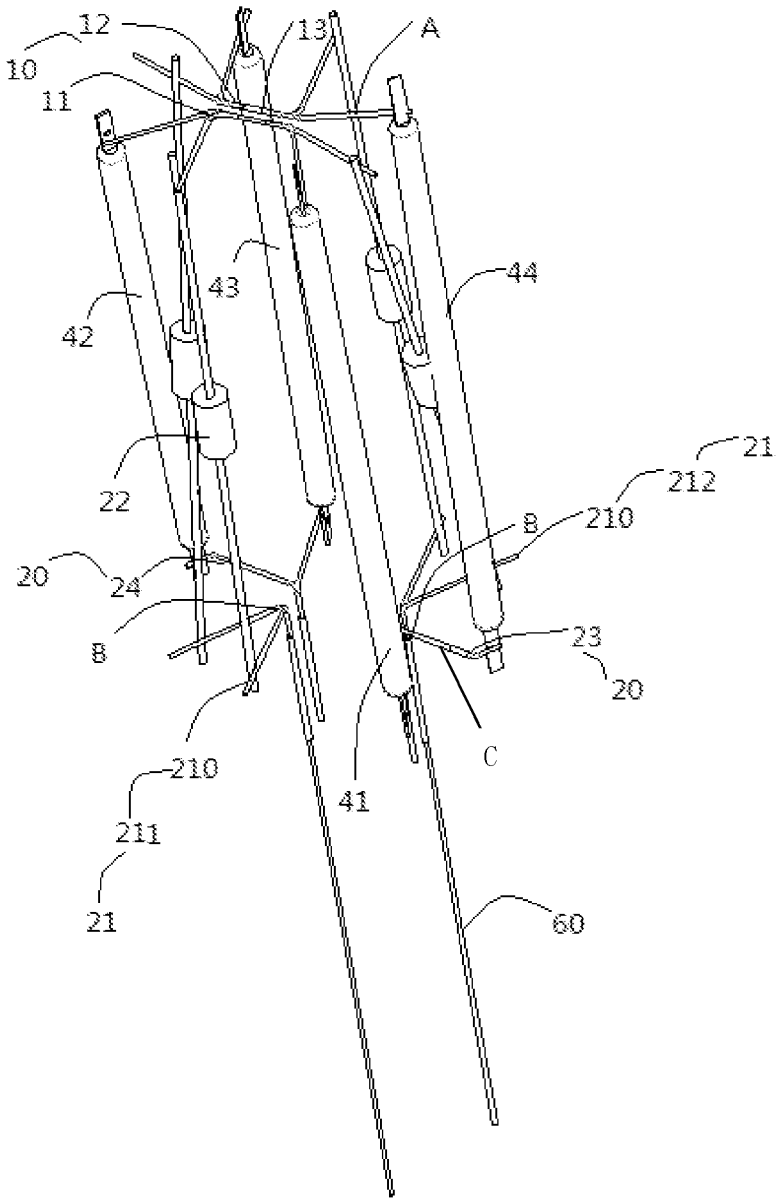
FIG. 1 is a schematic diagram showing the connection structure of a bridge, a filament and a rectifier diode in a filament lamp lighting module according to the present invention.

Upper Bridge—10, First Upper Bridge—11, Second Upper Bridge—12, Bridge Body—13, upper Bridge Arm—A, Lower Bridge—20, Rectifying Bridge—21, Rectifying Bridge Arm—210, First Rectifying Bridge—211, Second Rectifying Bridge—212, Rectifying Diode—22, First Lower Bridge—23, Second Lower Bridge—24, Node—B, Lamp Cap—30, Stem—31, Column 32, Binding end—321, Base—33, First Filament—41, Second Filament—42, Third Filament—43, Fourth Filament—44, Filter Capacitor—50, External Power line—60, Bulb hosing—70, lower bridge arm—C.

DETAILED DESCRIPTION OF PREFERRED EMBODIMENTS

The following description is intended to disclose the present invention so as to enable those skilled in the art to implement the invention. The embodiments in the following description are by way of example only, and other obvious variations will occur to those skilled in the Art. The basic principle of the invention defined in the following description can be applied to other implementations, modified, improved and equivalent schemes and other schemes without departing from the spirit and scope of the utility model.

It should be understood by those skilled in the art that in the disclosure of the present invention, the orientation or positional relationship indicated by the terms "longitudinal", "transverse", "upper", "lower", "front", "rear", "left", "right", "vertical", "horizontal", "top", "bottom", "inner", "inner" and the like is based on the orientation or positional relationship shown in the drawings, which is only for the convenience of describing the invention and simplifying the description, but does not indicate or imply that the referred device or element must have a specific orientation, be constructed and operated in a specific orientation, and thus the above terms cannot be understood as limiting the invention.

It can be understood that the term "a or an" should be understood as "at least one" or "one or more", that is, in one embodiment, the number of an element may be one, while in other embodiments, the number of the element may be multiple, and the term "an" cannot be understood as limiting the number.

Please refer to FIG. 1 which is a schematic diagram showing the connection structure of a bridge, a filament and a rectifier diode and in this figure, the bridge includes an upper bridge 10 and a lower bridge 20, in which the upper bridge 10 includes a first upper bridge 11 and a second upper bridge 12, and the lower bridge 20 includes two rectifying bridges 21: a first rectifying bridge 211 and a second rectifying bridge 212; and the first rectifying bridge 211 and the second rectifying bridge 212 respectively comprise two rectifying bridge arms 210, the two rectifying bridge arms 210 of the first rectifying bridge 211 are respectively connected with one ends of two rectifying diodes 22, and the other ends of the two rectifying diodes 22 are respectively connected with the first upper bridge 11 and the second upper bridge 12. In the same way, two rectifying bridge arms 210 of the second rectifying bridge 21 are connected to one ends of two rectifier diodes 22, and the other ends of the two rectifier diodes 22 are connected to the first upper bridge 11 and the second upper bridge 12 respectively; It should be mentioned that different terminals (anode or cathode) with opposite polarities of the two rectifier diodes 22 on the first rectifying bridge 211 are connected with the two rectifying bridge arms 210, different terminals (anode or cathode) with opposite polarities of the two rectifier diodes 22 on the second rectifying bridge 212 are connected with the two rectifying bridge arms 210, and the rectifying bridge 21 is connected with an external power line 60 which is connected to different rectifying bridges 21 at the lamp cap 30, thereby forming a rectifying circuit between the upper bridge 10 and the lower bridge 20. Therefore, by way of the rectifying circuit of the bridge, a power supply driving of the filament lamp can be made in the bulb hosing, and the conversion from AC to DC can be realized without further installing other power drives, thus greatly reducing the manufacturing cost of the filament lamp.

Figure 2:
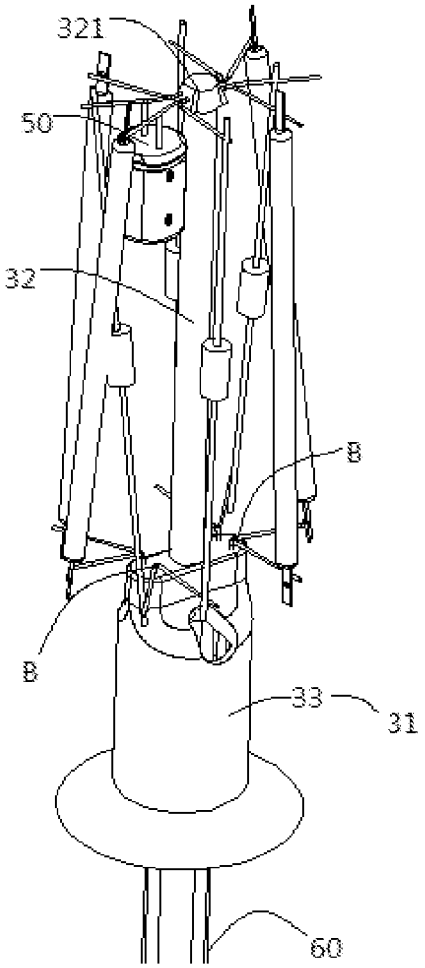
FIG. 2 is a schematic diagram showing a three-dimensional structure of a preferred embodiment of a filament lamp lighting module according to the present invention.
Figure 3:
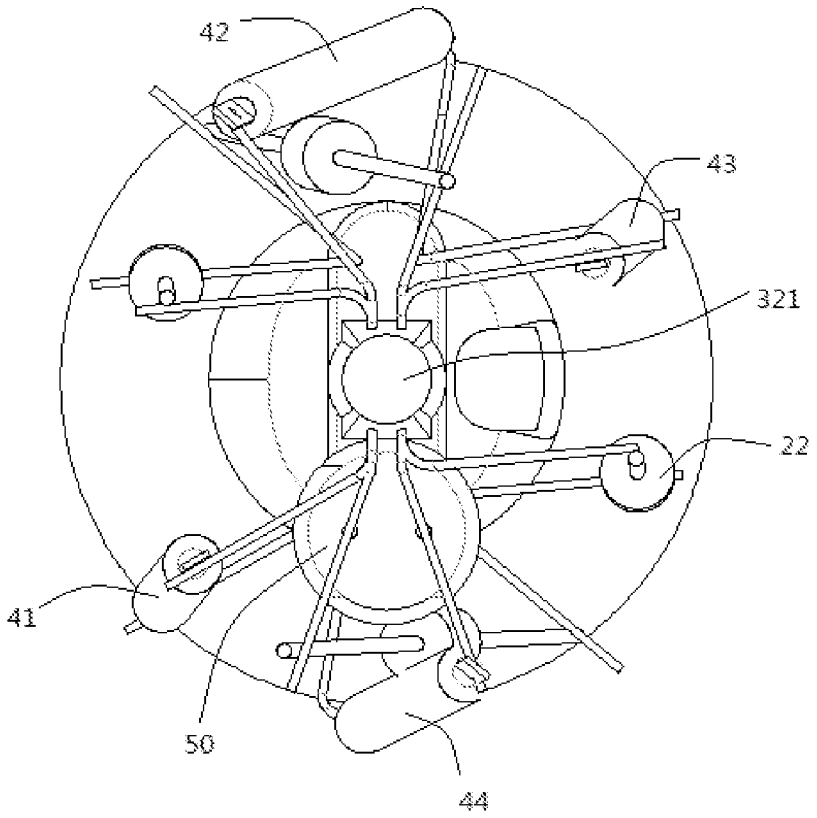
FIG. 3 is a schematic diagram showing a top face structure of a preferred embodiment of a filament lamp lighting module according to the present invention.

It should be noted that, referring to FIGS. 1-3, the upper bridge 10 has a plurality of upper bridge arms A for connecting ends of the rectifier diodes 22 and ends of filaments; continuingly referring to FIG. 1, the rectifying bridge arms 210 of each rectifying bridge 21 is in a V-shaped structure, and the upper bridge arms A extend from both ends of the upper bridge 10, so that the filaments and rectifier diodes connected between the upper bridge arms and the lower bridge arms are relatively parallel to the stem 31. Each upper bridge arm also includes a bridge body 13, and the upper bridge arm A extends outward along the stem 31 from two ends of the bridge body 13; in the preferred embodiment of the present invention, four upper bridge arms A of the upper bridge 10 are provided, and are arranged two by two respectively at two ends of the bridge body 13, in which the upper bridge arms A at the same end of each upper bridge 10 presents a V-shaped bifurcated arrangement.

Further, combining FIGS. 1 and 2, the stem includes a column 32 and a base 33, the column 32 is connected to a middle of the base 33, and a binding end 321 is provided at a top of the column 32 and is connected to the bridge bodies 13 of the first upper bridge 11 and the second upper bridge 12 respectively, and the binding end 321 is an insulator for relatively fixing the upper bridge 10 and isolating different upper bridges 10. The binding end 321 at the top of the stem 31 is preferably implemented as a hemispherical shape or a polyhedral structure with a slope, and a moving space for each bridge body 13 is defined by the binding end 321; in another feasible embodiment of the present invention, the binding end 321 is configured as a hemispherical shape or a polyhedral structure, and an isolation between different upper bridges 10 can be realized by abutting the bridge bodies against different positions of the binding end 321 at the top of the stem 31. In the present invention, there are preferably two upper bridges 10, and each upper bridge 10 is provided with four upper bridge arms A; in other preferred embodiments of the present invention, a number of the upper bridges 10 can be set as an even number greater than 2, and that of the corresponding lower bridges 20 can be set as three or more; it can be understood by those skilled in the art that the number of upper bridges 10 and lower bridges 20 is not a limitation on the present invention for the purpose of realizing the purpose of the present invention.

The lower bridge 20 includes a plurality of bridge arms for supplying power to the filaments; continuingly referring to a preferred embodiment shown in FIG. 1, the lower bridge 20 includes a first lower bridge 23 and a second lower bridge 24 each of which has a node B, and the node B extends outward along the stem to form two bridge arms which are in a V-shaped structure, and each bridge arm is connected with a filament for supplying power thereto. The bridge arms comprise a lower bridge arm C and at least two rectifying bridge arms 210.

Figure 4:
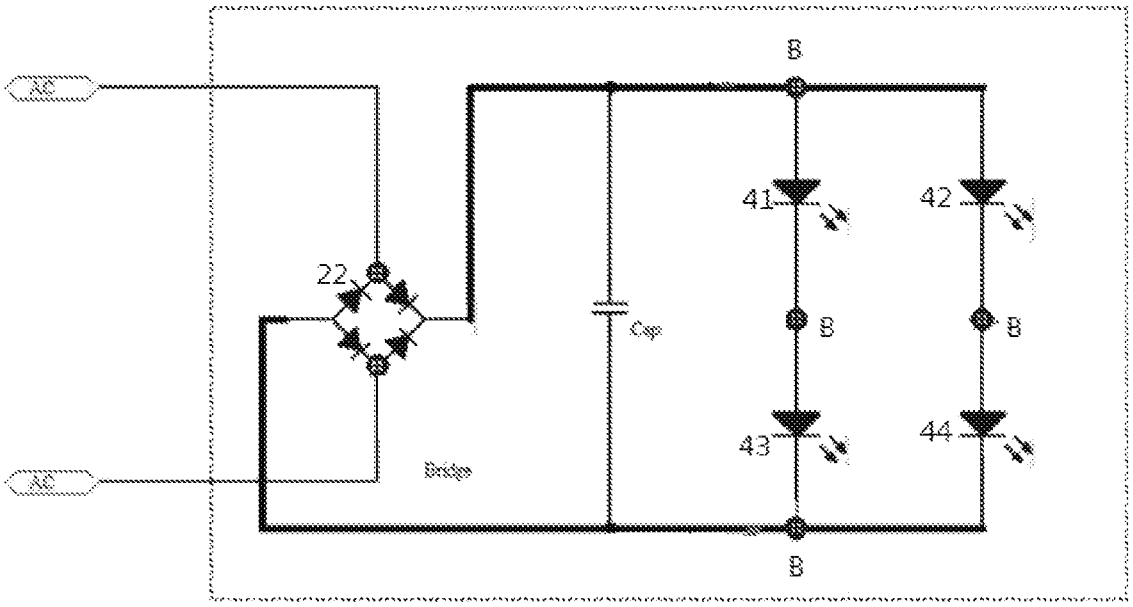
FIG. 4 is a schematic diagram showing a circuit structure of a preferred embodiment of a filament lamp lighting module according to the present invention.

Specifically, the lower bridge arm C of the first lower bridges 23 are connected to one ends of the filaments, and the other ends of the filaments are respectively connected to the upper bridge arms A of the first upper bridge 11 or of the second upper bridge 12; for example and continuingly referring to FIG. 1, a first filament 41, a second filament 42, a third filament 43 and a fourth filament 44 are defined, in which lower ends of the first filament 41 and the third filament 43 are respectively connected with the two bridge arms of the first lower bridge 23, lower ends of the second filament 42 and the fourth filament 44 are respectively connected with two lower bridge arms C of the second lower bridge 24, an upper end of the first filament 41 is connected with the bridge arm A of the first upper bridge 11, an upper end of the second filament 42 is connected with the upper bridge arm A of the first upper bridge 11, an upper end of the third filament 43 is connected with the bridge arm A of the second upper bridge 12, and an upper end of the fourth filament 44 is connected with the bridge arm A of the second upper bridge 12, thereby realizing a circuit structure as shown in the circuit diagram of FIG. 4. The filaments connected with the same lower bridge 20 form a series structure and the filaments connected with different lower bridges 20 form a parallel structure; it should be noted that more than two lower bridge arms C of the first lower bridge 23 can be provided to form multiple series filaments, and at least two lower bridges 20 can be provided to form multiple parallel filaments; therefore, a multi-series and multi-parallel circuit structure can be provided by the designing of the upper bridge 10 and the lower bridge 20, which facilitates a model design of filament lamps with different lighting intensities.

In another preferred embodiment of the present invention, at least one constant current IC chip is provided in each of branches in parallel to stabilize a current of each branch, so as to realize a stable lighting for the filament; specifically, the constant current IC chip is preferably packaged in the filament lamp and is hiddenly installed in the branch circuit by encapsulation, so that the structure of the filament lamp is more aesthetic.

Furthermore, the filament lamp lighting module further comprises at least one filter capacitor 50 two connection terminals of which are electrically connected to the first upper bridge 11 and the second upper bridge 12 respectively, and the filter capacitor 50 is arranged on the top of the stem 31. In other optional embodiments of the present invention, the filter capacitor 50 can be arranged at a bottom of the first upper bridge 11 and the second upper bridge 12, and the filter capacitor 50 can be hiddenly installed through a surrounding design of multiple filaments, so as to improve aesthetic effect of the design.

Figure 5:
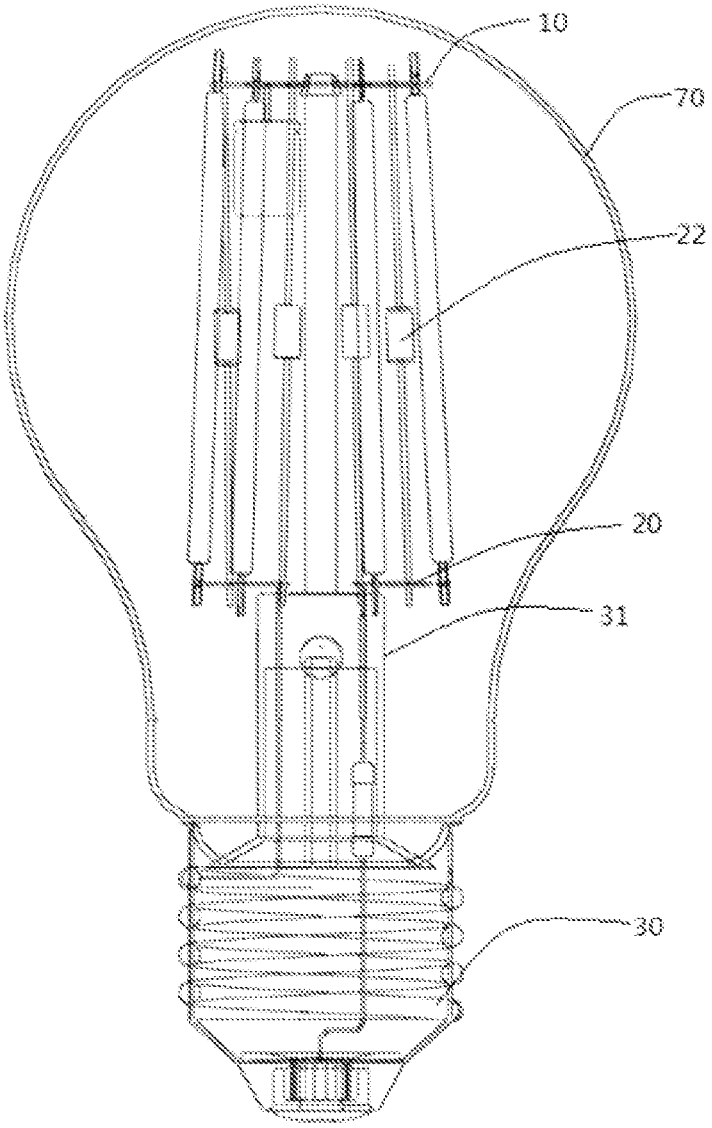
FIG. 5 is a schematic perspective view showing a filament lamp according to the present invention.

Referring to FIGS. 2 and 5, the filament lamp lighting module includes a stem 31 and a lamp cap 30 connected with the stem 31, in which the stem 31 has an annular raised base 33 made of glass, the glass base 33 has a hollow interior and is provided with two channels, and external positive and negative power lines are connected to an upper surface of the glass base 33 through the channels of the glass base 33; the two rectifying bridge nodes B have downward extending wires for connecting with the external power line 60; it should be noted that the downward extending wire of the rectifying bridge 21 can be directly connected with the external circuit by spot welding, so that a manufacturing process is simpler and more convenient, and a production efficiency of the filament lamp can be greatly improved.

Figure 6:
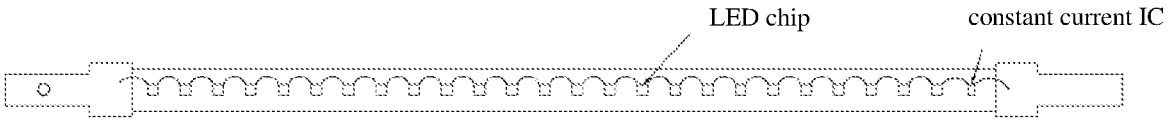
FIG. 6 is a schematic diagram showing a filament structure of the present invention.

In other preferred embodiments of the present invention, combining FIGS. 1 and 6, at least one safety component can be provided on the wires extending downward from the node B of the rectifying bridge, and the safety component includes but is not limited to a safety resistor and a fuse, to prevent an overvoltage and overcurrent from damaging the constant current IC chip and rectifier diode 22 in the bulb hosing. In addition, outer surfaces of the rectifier diode and the filter 50 are coated with a reflective material including, but not limited to, an aluminum film or a laser film.

In order to get an aesthetic appearance of a filament lamp lighting module according to the present invention, in another preferred embodiment of the present invention, the rectifier diode 22 is arranged on two rectifying bridge arms 210 of the rectifying bridge 21, and by setting a length of the rectifying bridge arms 210 to be less than the bridge arm A of the lower bridge 20 connecting the filaments, the rectifier diode 22 can be hiddenly installed in a lumen formed by surrounding the filaments by setting a position of the lower bridge 20 and a connection position of the filaments.

Continuingly referring to FIG. 5, because there is no relevant PCB circuit board and driving circuit in the lamp cap 30, a processing of the lamp cap 30 can be reduced and a defective rate of the lamp cap 30 can be decreased. In addition, in other feasible embodiments, there is a large space in the lamp cap 30, in which related dimmer module and control chip, such as a WiFi module, can be added for controlling a switching or a lighting mode of filament lamps by mobile phones or computers, so as to realize more functions in the same space volume.

Figure 7:
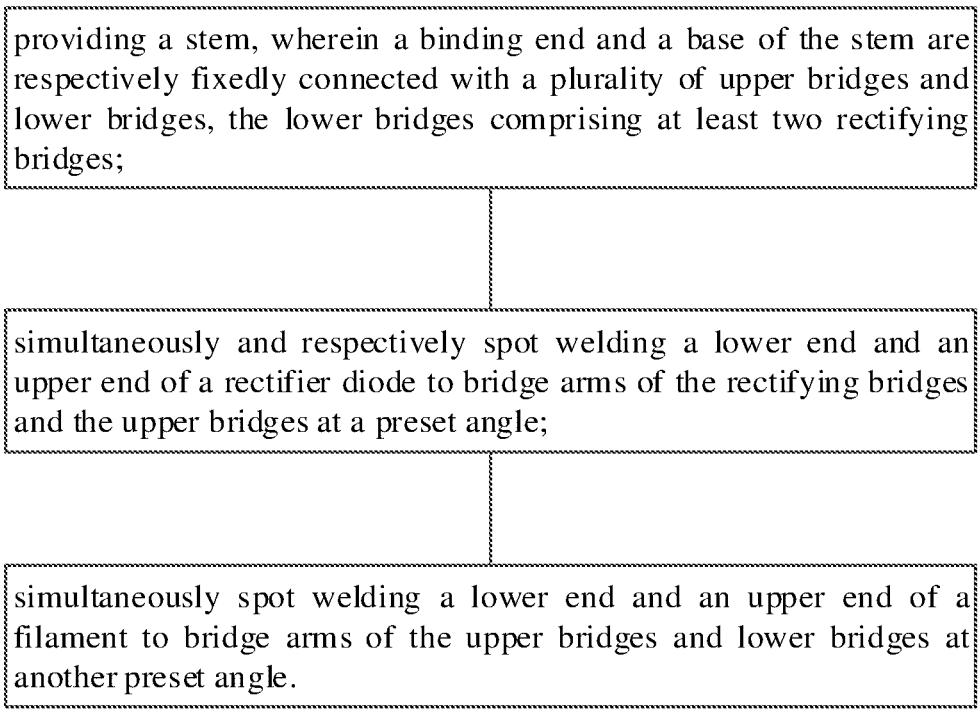
FIG. 7 shows a flow chart of a manufacturing method of a filament lamp lighting module according to the present invention.

It should be noted that, referring to FIG. 7, a manufacturing process of the above-mentioned lighting module is similar to that of an incandescent lamp, and by spot welding the filament and rectifier diode 22 on the upper bridge arms A of the upper bridge 10 and bridge arms of the lower bridge 20, the manufacturing process is simple and efficient, and a mass production with high efficiency and low cost can be achieved.

The flowcharts and block diagrams in the drawings illustrate the architecture, functions and operations of possible implementations of systems, methods and computer program products according to various embodiments of the present invention. In this regard, each block in the flowchart or block diagram may represent a module, a program segment or a part of code containing one or more executable instructions for implementing specified logical functions. It should also be noted that in some alternative implementations, the functions noted in the blocks may also occur in a different order from that noted in the drawings. For example, two blocks in succession may actually be executed in substantially parallel, or they may sometimes be executed in a reverse order, depending on the functions involved. It should also be noted that each block in the block diagrams and/or flowcharts, along with combinations of blocks in the block diagrams and/or flowcharts, can be implemented with dedicated hardware-based systems that perform specified functions or operations, or can be implemented with combinations of dedicated hardware and computer instructions.

It should be understood by those skilled in the art that the embodiments of the present invention described above and shown in the drawings are only taken as examples and do not limit the present invention; the function and structural principle of the invention have been shown and explained in the embodiments; any variation and modification can be made to the embodiments of the invention without departing from the principle.

What is claimed is:

1. A filament lamp lighting module, wherein comprises a lamp cap, a filament, and a stem, wherein the lamp cap is connected with the stem, the lamp cap is used to be connected with an external power supply, and the filament is used to be electrically connected with the external power supply, wherein the filament lamp lighting module comprises:

at least two upper bridges, the at least two upper bridges are each provided with at least two upper bridge arms; and at least three lower bridges, each lower bridge is provided with a bridge arm;

wherein the at least three lower bridges comprises two rectifying bridges, the bridge arms comprise a lower bridge arm and at least two rectifying bridge arms, the two rectifying bridges comprise the at least two rectifying bridge arms; the rectifying bridges are connected with the external power supply; two of the rectifying bridge arms are respectively connected with one ends of two rectifying diodes, and the other ends of the two rectifying diodes are respectively connected with different upper bridges, forming a rectifying circuit; the lower bridges comprise the lower bridge arm connected with one end of the filament, and the other end of the filament is connected with one upper bridge arm, for rectifying and supplying power to the filament.

2. The filament lamp lighting module according to claim 1, wherein two rectifying bridge arms extend from the rectifying bridge and the two rectifying bridge arms are respectively connected with one ends of two rectifier diodes, and the other ends of the two rectifier diodes are respectively connected with bridge arms of different upper bridges.

3. The filament lamp lighting module according to claim 1, wherein each upper bridge is provided with a bridge body, the bridge body is located at a top of the stem, and the upper bridge arms are located at both ends of the bridge body and in a bifurcated structure.

4. The filament lamp lighting module according to claim 3, wherein a binding end is provided at the top of the stem, the binding end is connected with a middle of the bridge body, the binding end is connected with a plurality of bridge bodies, and the plurality of bridge bodies are relatively fixed at the top of the stem.

5. The filament lamp lighting module according to claim 1, wherein the lower bridges comprise at least one node, each node is connected with a wire extending from bottom to top, and one of the rectifier diodes is connected to the wire connected with the node.

6. The filament lamp lighting module according to claim 1, wherein a constant current chip is provided inside the filament for outputting a constant current to the filament, and the constant current chip is electrically connected with a wire.

7. The filament lamp lighting module according to claim 5, wherein the filament lamp lighting module comprises a filter capacitor, the filter capacitor is fixed above or below the upper bridges, two terminals of the filter capacitor are respectively electrically connected and fixed to two different upper bridges, and the filter capacitor is connected with a discharge resistor.

8. The filament lamp lighting module according to claim 7, wherein a surface of the filter capacitor is coated with a reflective material.

9. The filament lamp lighting module according to claim 5, wherein the wire is connected below each node, the wire is connected with the lamp cap and connected with the external power supply; and a safety component is disposed at the wire below the node.

10. The filament lamp lighting module according to claim 5, wherein the lamp cap is connected to the stem, the stem is provided with a column and a base, and the rectifying bridges have at least one node, the wire at a bottom of the node is connected with the wire end at the base, and the rectifying bridges are connected with the external power line through the wire.

11. The filament lamp lighting module according to claim 10, wherein the lamp cap is internally provided with an accommodating cavity, a dimmer module is disposed in the accommodating cavity, and the dimmer module is connected with at least one of a WiFi module, a Zigbee module and a Bluetooth module, adjusting an emission luminance and a lighting mode of the filament lamp lighting module.

12. A filament lamp, comprising:

a bulb housing; and the filament lamp lighting module according to claim 1;

wherein a filament of the filament lamp lighting module comprises LED lighting strips.

* * * * *